US005296051A

United States Patent [19]

Inokuti et al.

[11] Patent Number: 5,296,051

[45] Date of Patent: Mar. 22, 1994

[54] METHOD OF PRODUCING LOW IRON LOSS GRAIN-ORIENTED SILICON STEEL SHEET HAVING LOW-NOISE AND SUPERIOR SHAPE CHARACTERISTICS

[75] Inventors: Yukio Inokuti; Kazuhiro Suzuki, both Chiba, Japan

[73] Assignee: Kawasaki Steel Corporation, Japan

[21] Appl. No.: 16,521

[22] Filed: Feb. 11, 1993

[51] Int. Cl.[5] ..... H01F 1/04

[52] U.S. Cl. ..... 148/113; 148/111; 219/121.12; 219/121.17; 219/121.19; 219/121.20; 219/121.35

[58] Field of Search ..... 148/111, 112, 113; 219/121.12, 121.17, 121.19, 121.20, 121.34, 121.35

[56] References Cited

U.S. PATENT DOCUMENTS

| | | | |
|---|---|---|---|
| 3,076,160 | 1/1963 | Daniels | 148/111 |
| 4,915,750 | 4/1990 | Salsgiver et al. | 148/112 |
| 4,919,733 | 4/1990 | Salsgiver et al. | 148/113 |
| 5,146,063 | 9/1992 | Inokuti | 219/121.35 |

FOREIGN PATENT DOCUMENTS

| | | | |
|---|---|---|---|
| 4-32517 | 2/1992 | Japan | 148/113 |
| 4-323322 | 11/1992 | Japan | 148/113 |

*Primary Examiner*—John P. Sheehan
*Attorney, Agent, or Firm*—Austin R. Miller

[57] ABSTRACT

A method of producing a low iron loss grain oriented silicon steel sheet which generates improved magnetostrictive characteristics when used as a stacked iron core and low noise when used in a stacked transformer, as well as superior shape characteristics. A grain oriented finish-annealed silicon steel sheet is coated with an insulating film. The surface of the grain oriented silicon steel sheet is irradiated with an electron beam along a multiplicity of spaced paths so as to refine the magnetic domains. The irradiation with the electron beam is conducted continuously or intermittently along a waveform path on the surface of the grain oriented silicon steel, and the wave-form, such as a zigzag form, has a period length much smaller than the width of the grain oriented silicon steel sheet, and line interconnecting the centers of successive waves extends substantially perpendicularly to the direction of rolling of the grain oriented silicon steel sheet.

7 Claims, 5 Drawing Sheets

METHOD OF PRODUCING LOW IRON LOSS GRAIN-ORIENTED SILICON STEEL SHEET HAVING LOW-NOISE AND SUPERIOR SHAPE CHARACTERISTICS

BACKGROUND OF THE INVENTION

1. Field of the Invention

This invention relates to a method of producing, by employing electron beam irradiation, a low iron loss grain oriented silicon steel sheet which generates improved magnetostrictive characteristics when used as a stacked iron core and low noise when used in a stacked transformer, as well as superior shape characteristics.

Grain oriented silicon steel sheets are used mainly as the core materials of electrical components such as transformers or the like. In general, grain oriented silicon steel sheets are required to have such magnetic characteristics that the magnetic flux density (represented by $B_8$) is high and that the iron loss (represented by $W_{17/50}$) is low. It is also required that the surfaces of the steel sheet have insulating films with excellent surfaces.

The energy crisis that the world now faces requires reduction of losses of electrical power. This has given rise to a strong demand for grain oriented silicon steel sheets having reduced iron loss.

2. Description of the Related Art

Grain oriented silicon steel sheets have undergone various treatments for improving magnetic characteristics. For instance, treatment has been conducted to attain a high degree of concentration of the secondary recrystallization grains in the Goss orientation. It has also been attempted to form, on a forsterite film formed on the surface of the steel sheet, an insulating film having a small thermal expansion coefficient so as to impart a tensile force to the steel sheet. Thus, grain oriented silicon steel sheets have been produced through complicated and diversified processes which require very strict controls.

Among these treatments, one major technique for reducing iron loss of grain oriented steel sheet has been the improvement of the aggregation structure of Goss orientation secondary recrystallization grains.

Hitherto, as a method for controlling the secondary recrystallization grains, preferential growth of Goss orientation secondary recrystallization grains has been obtained by using primary recrystallization grain growth inhibiting agents such as AlN, MnS and MnSe, known as "inhibitors".

In recent years various techniques other than metallurgical measures have been developed for controlling secondary recrystallization grains for reducing iron loss. For instance, techniques for reducing iron loss by irradiation with laser beams have been proposed in IRON AND STEELS, by Tadashi Ichiyama 69(1983), P895, Japanese Patent Publication No. 57-2252, Japanese Patent Publication No. 57-53419, Japanese Patent Publication No. 58-26405 and Japanese Patent Publication No. 58-26406. Methods also have been proposed which employ plasma irradiation as disclosed, for example, in Japanese Patent Laid-Open No. 62-96617, Japanese Patent Laid-Open 62-151511, Japanese Patent Laid-Open No. 62-151516 and Japanese Patent Laid-Open No. 62-151517. In these methods local treatment is introduced into the steel sheet by irradiation of the steel sheet surface by laser beam or plasma, so as to refine the magnetic domains, thereby reducing iron loss.

These methods relying upon irradiation with laser beam or plasma, however, inevitably raise the cost of reducing iron loss, because the energy efficiency is as low as 5 to 20%.

Under these circumstances we have proposed a method in which an electron beam generated by electric power of high voltage and low current is locally and intermittently applied along the widthwise direction which intersects the rolling direction of the sheet, so as to forcibly introduce a coating film into the matrix iron. Such a method is disclosed, for example, in Japanese Patent Laid-Open No. 63-186826, Japanese Patent Laid-Open No. 2-118022 and Japanese Patent Laid-Open No. 2-277780.

This method exhibits very high energy efficiency, as well as high scanning speed, thus offering remarkably improved production efficiency as compared to known methods for refining magnetic domains.

The methods disclosed in our above-mentioned Japanese Patent Laid-Open specifications are directed to production of grain oriented silicon steel sheet for use as a material for a wound core transformer. In the production of a core of this kind, the wound core formed from a grain oriented steel sheet is subjected to stress-relieving annealing. Therefore, no substantial noise tends to be generated in the wound core transformer during operation of the transformer.

In contrast, a stacked transformer of that kind generates a high level of noise, requiring strong measures to be taken for reducing the noise.

In particular, the grain oriented steel sheets produced by the method proposed in the aforementioned Japanese Patent Laid-Open specification cannot be practically used in stacked transformers, due to high levels of noise.

Furthermore, these techniques are still unsatisfactory in that the products exhibit large fluctuations in magnetostrictive and sheet shapes, making it difficult to stably produce steel sheets having acceptable product quality.

On the other hand, U.S. Pat. No. 4,919,733 discloses a method for refining magnetic domains by irradiation with electron beams, wherein the surface energy density on the electron beam scan line is set to a level not lower than 60 J/in$^2$ (9.3 J/cm$^2$).

Steel sheets which have undergone this electron beam treatment, however, exhibit inferior noise characteristics when employed in a stacked transformer, as compared with steel sheets which have not undergone such electron beam treatment. In particular, the noise characteristics are extremely poor during operation of the transformer after the electron beam treatment has been conducted under the conditions mentioned above, as compared with sheets which have not undergone such treatment.

U.S. Pat. No. 4,915,750 proposes a method of producing a grain oriented silicon steel sheet for use as a material of a wound core transformer, employing refining of magnetic domains by irradiation with an electron beam. This method is directed only to the production of a wound core transformer as distinguished from a stacked transformer to which the present invention pertains and which suffers from the noise problem.

SUMMARY OF THE INVENTION

Accordingly, an object of the present invention is to provide a method for producing a grain oriented steel sheet of high quality which generates not only low iron loss but also improved magnetostrictive and noise characteristics, as well as superior shape characteristics, thereby overcoming the above-described problems of the known art.

To these ends, according to one aspect of the present invention, there is provided a method of producing a low iron loss grain oriented silicon steel sheet which generates improved magnetostrictive characteristic when used as a stacked iron core and low noise when used in a stacked transformer, as well as superior shape characteristic, comprising the steps of: preparing a grain oriented finish-annealed silicon steel sheet; forming an insulating film on a surface of said grain oriented silicon steel sheet; and irradiating said surface of said grain oriented silicon steel sheet with an electron beam along a multiplicity of spaced paths so as to refine the magnetic domains; wherein the irradiation with said electron beam is conducted continuously or intermittently along a wave-form path on the surface of said grain oriented silicon steel, said wave-form having a period length much smaller than the width of said grain oriented silicon steel sheet and the line interconnecting the centers of the successive waves extends substantially perpendicularly to the direction of rolling of said grain oriented silicon steel sheet.

The above and other objects, features and advantages of the present invention will become clear from the following description when the same is read in conjunction with the accompanying drawings.

DETAILED DESCRIPTION OF THE INVENTION

In order to solve the aforesaid problems of the known art, the present inventors have conducted various experiments in regard to the conditions of the electron beam irradiation, thus accomplishing the present invention.

A detailed description will now be given of the experiment, with reference to FIG. 1 which shows an electron beam irradiation apparatus employed in the experiment.

Figure 1:
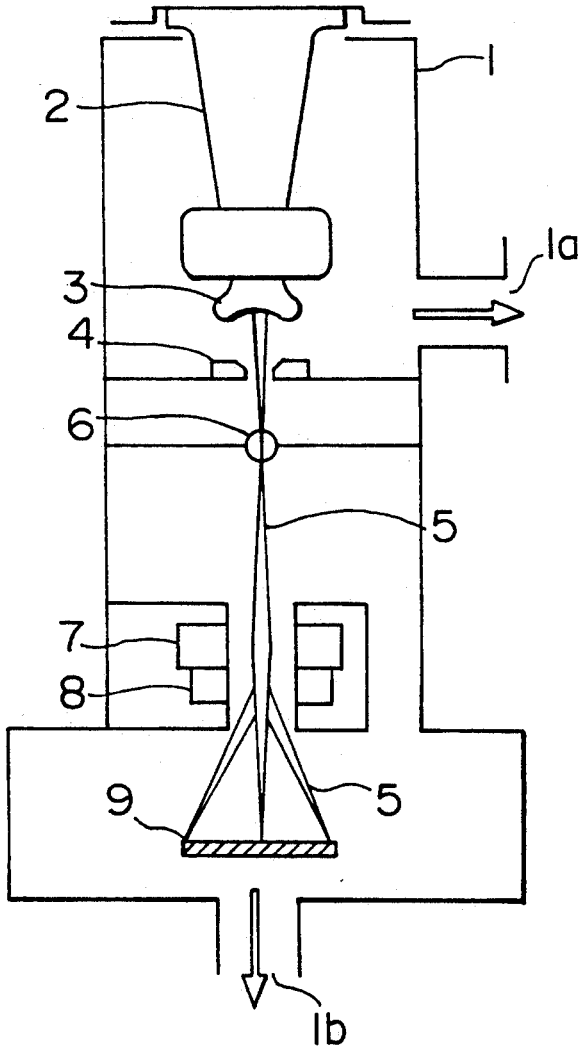
FIG. 1 is a schematic illustration of an electron beam irradiation device employed in an experiment conducted in the course of achievement of the present invention.

Referring to FIG. 1, the electron beam irradiation apparatus has a vacuum chamber 1 which has evacuating ports 1*a*, 1*b* and which maintains vacuum preferably at a high level of $10^{-2}$ Torr or lower. Numeral 2 designates a high-tension insulator, while numeral 3 designates an electron gun which emits electrons. Numeral 4 denotes an anode disposed to oppose the electron gun 3 so as to accelerate the electrons emitted from the electron gun 3. Numeral 6 denotes a column valve which serves to maintain a high level of vacuum in the region where the electron beam is generated, while 7 designates a condenser lens for condensing the electron beam 5.

Numeral 8 designates a biasing coil which biases and deflects the direction of the electron beam 5 condensed by the condenser lens 7 in a wavy or zigzag form, thus making it possible to irradiate a grain oriented silicon steel sheet with the electron beam along a wavy or zigzag form. The electron beam irradiation apparatus has means for selecting irradiation mode between an intermittent irradiation mode and a continuous irradiation mode.

By irradiating the grain oriented silicon steel sheet 9 with an electron beam produced by this electron beam irradiation apparatus, it is possible to form tiny linear thermal strain regions in the grain oriented steel sheet, thus refining the magnetic domain structures, thus improving iron loss characteristic, without destroying a coating layer on the grain oriented silicon steel sheet.

A description will now be given of experiments executed by the inventors.

Experiment 1-(1)

A silicon steel slab was prepared having a composition containing C: 0.082 wt. %, Si: 3.54 wt. %, Mn: 0.82 wt. %, Mo: 0.013 wt. %, sol.Al: 0.028 wt. %, Se: 0.021 wt. % and Sb: 0.022 wt. %. The slab was heated for 3 hours at 1380° C., followed by hot rolling, whereby a hot-rolled sheet 2.2 mm thick was obtained.

The hot-rolled slab was then subjected to a cold rolling and a subsequent annealing conducted for 3 minutes at 1050° C., followed by a second cold rolling, whereby a final cold-rolled sheet of 0.23 mm thick was obtained.

This final cold-rolled sheet was then subjected to decarburization and primary recrystallization annealing conducted in wet hydrogen atmosphere of 840° C.

Then, an annealing separation agent in the form of a slurry composed mainly of MgO was applied to the surface of the steel sheet, and secondary recrystallization annealing was conducted either in accordance with a cycle A or B shown below, followed by a purification annealing.

In the annealing cycle A, the temperature of the steel sheet was raised at a rate of 10° C./h and the secondary crystallization annealing was conducted for 50 hours at 850° C., allowing preferential growth of secondary recrystallization grain of Goss orientation. Then, purification annealing was conducted for 5 hours in a dry hydrogen atmosphere at 1220° C.

In the annealing cycle B, the steel sheet was annealed for 15 hours at 850° C. and the temperature was raised to 1180° C. at a rate of 12° C./hr to allow growth of Goss orientation secondary recrystallized grains. Then, purification annealing was executed for 5 hours in a dry hydrogen atmosphere at 1230° C.

Then, an insulating film mainly composed of a phosphate and colloidal silica was formed on each of the steel sheets, whereby two types of grain oriented silicon steel sheets were obtained.

Then, electron beam irradiation was conducted by employing the electron beam apparatus of FIG. 1, in either one of the following two irradiation modes.

Figure 2:
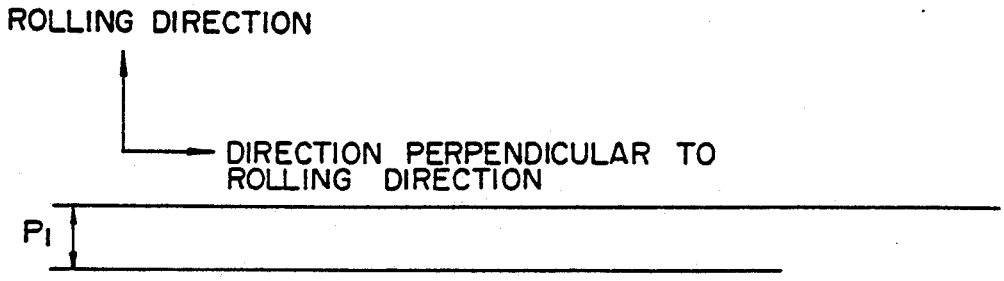
FIG. 2 PRIOR ART
FIG. 2 is a plan view schematically showing the known method for applying an electron beam.

In the first irradiation mode, as shown in FIG. 2, the electron beam was applied along straight paths extending in the direction perpendicular to the direction of rolling of the steel sheet at a scanning pitch $P_1$ of 6 mm.

Figure 3:
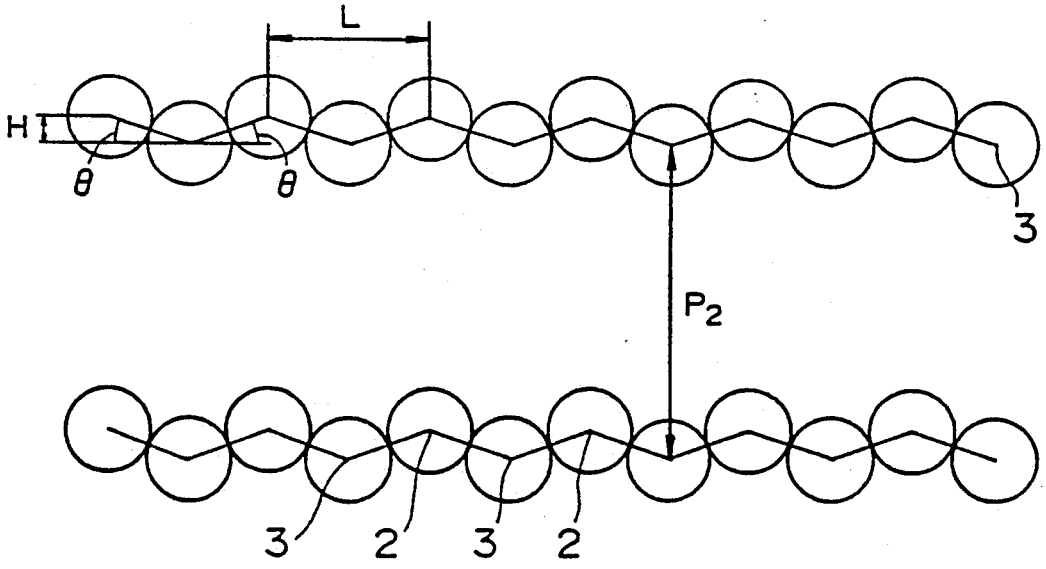
FIG. 3 is a plan view schematically showing the manner in which an electron beam is applied in accordance with the present invention.
Figure 4A:
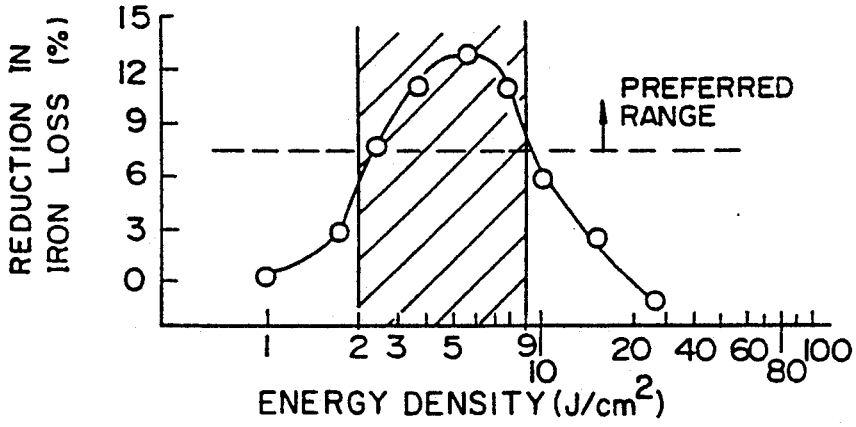
FIGS. 4(A), 4(B), 4(C) and 4(D) are graphs showing how the improvement in iron loss characteristic, reduction in the exciting power, noise and the C-deflection amount, respectively, are influenced by the energy density when the electron beam is applied in a zigzag manner.
Figure 4B:
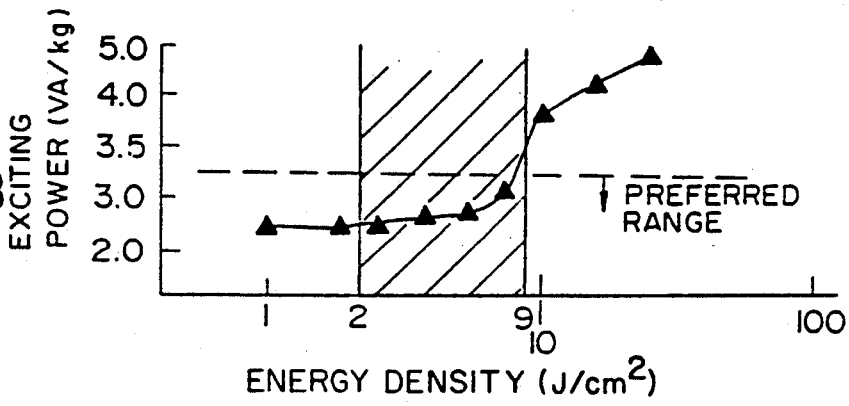
Figure 4C:
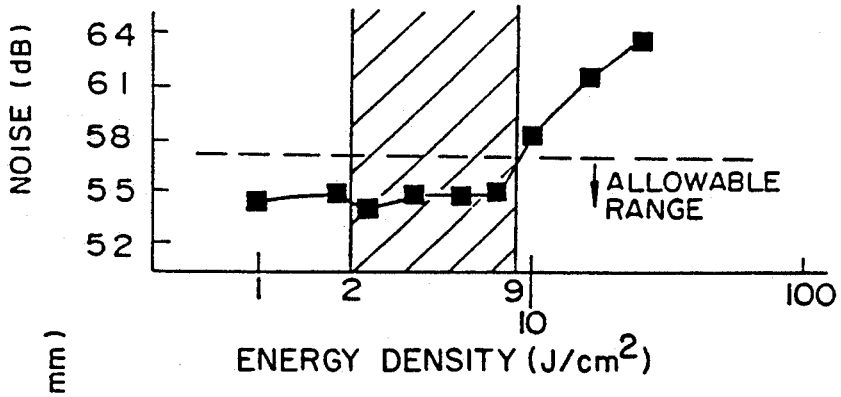
Figure 4D:
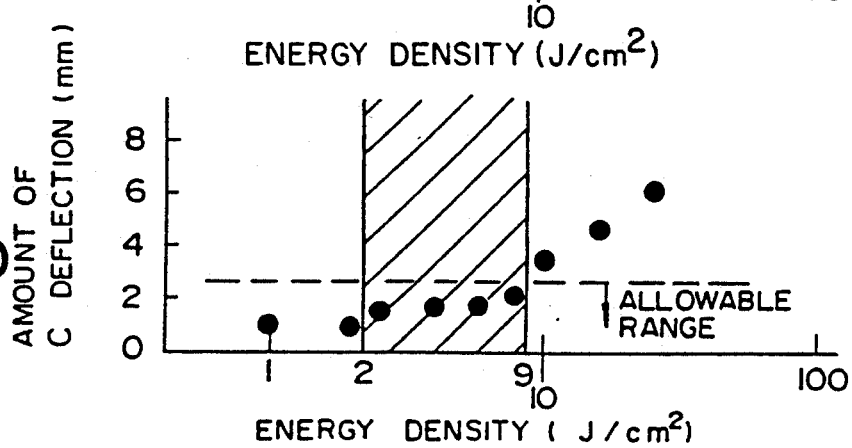

Beam acceleration voltage: 150 KV
Beam current: 1.0 mA
Beam diameter: 0.20 mm
Energy density: 6.0 J/cm$^2$
Scanning velocity: 1250 cm/sec In the second irradiation mode, as shown in FIG. 3, the electron beam was applied intermittently so as to irradiate apices 2 and bottoms 3 of the zigzag wave 1. In FIG. 3, the centers of the consecutive circles show the points irradiated with the electron beam.

The zigzag path of the beam was so determined to have an amplitude H of 0.35 mm, a period length of 0.6 mm and a scanning pitch $P_2$ of 6 mm. The angle $\theta$ of inclination of the zigzag wave with respect to the direction perpendicular to the steel sheet rolling direction was 18.4°.

The condition of application of the electron beam was as follows:

Beam acceleration voltage: 150 KV
Beam current: 1.0 mA
Beam diameter: 0.25 mm
Energy density: 6.0 J/cm$^2$
Scanning velocity: 1000 cm/sec For comparison, two types of samples were prepared also for steel sheets which had not undergone the electron beam irradiation: one annealed in accordance with the aforesaid annealing cycle A and the other annealed in accordance with the aforesaid annealing cycle B.

Characteristics or properties such as magnetic characteristics, magnetostrictive characteristic, noise characteristic and shape characteristic were examined for all these samples, the results being shown in Table 1.

The magnetostrictive characteristic was evaluated on the basis of the exciting electric power which is usually expressed in terms of VA/Kg.

The noise (dB) of each transformer was measured by using a sound level meter specified by JIS (Japanese Industrial Standard) 1502 at positions directly above the three legs and at positions spaced 50 cm apart from the respective legs. Then, the mean values of the measured noise levels were calculated. The results of the measurement were evaluated by normalizing them to the values at 1.7 T/50 Hz. The noise measurement was conducted by using an A scale as specified by JIS 1502.

Figure 7:
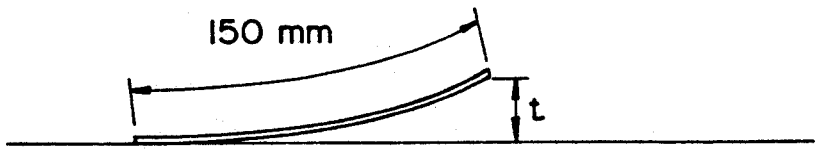
FIG. 7 is a side elevational view of a test piece illustrative of the manner of measuring the amount of C-deflection.

As to shape characteristics, test pieces of 150 mm width were cut in a direction perpendicular to the rolling direction from each steel sheet before electron beam irradiation and from the steel sheet after electron beam irradiation. Then, each test piece was placed on a flat surface with its concave side facing upward, and one side edge of the test piece was pressed into contact with the flat surface as shown in FIG. 7. The distance t (mm) between the other side edge and the flat surface was measured and used as the index of the amount of warp or deflection. This amount will be referred to as "C" deflection.

The described methods of evaluation apply also to other experiments and examples which will be described later.

TABLE 1

| | | Magnetic Characteristics | | | | |
|---|---|---|---|---|---|---|
| Irradiation Mode | Annealing Cycle | Iron Loss $W_{17/50}$(W/kg) | Magnetic Flux Density $B_8$/(T) | Excitation Power (VA/kg) | Noise (db) | C-Deflection (mm) |
| Linear | A | 0.80 | 1.91 | 4.1 | 60 | 4.0 |
| | B | 0.78 | 1.93 | 4.0 | 59 | 4.2 |
| Zigzag | A | 0.76 | 1.91 | 2.8 | 56 | 1.5 |
| | B | 0.79 | 1.93 | 2.7 | 54 | 1.4 |
| Not | A | 0.90 | 1.91 | 2.6 | 55 | 1.0 |
| Irradiated | B | 0.87 | 1.93 | 2.6 | 54 | 0.9 |

From Table 1, it is shown that the samples which had undergone the magnetic domain refining treatment by electron beam irradiation exhibit remarkably reduced iron loss as compared with samples which were not subjected to such treatment. It is to be understood, however, that the magnetostrictive characteristics, noise characteristics and shape characteristics were seriously impaired when the electron beams were applied along linear paths. Nevertheless, the magnetostrictive characteristics, noise characteristics and shape characteristics were remarkably improved when the electron beam irradiation was conducted in zigzag form, as compared with the case where the electron beam was applied along a straight path.

Experiment 1-(2)

The inventors also conducted an experiment to examine how the magnetostrictive characteristics, noise characteristics and shape characteristics are influenced by the energy density of the electron beam when the irradiation is conducted in a spot manner along a zigzag path.

In this experiment, the amplitude H of the zigzag wave was varied within the range between 0.35 and 0.80 mm. The energy density also was varied within the range between 1 and 30 J/cm$^2$. The scanning pitch $P_2$ was fixed at 6 mm.

Other conditions were as follows:

Beam acceleration voltage: 150 kV
Beam current: 0.5 to 1.5 mA
Beam diameter: 0.2 to 0.3 mm The magnetic characteristics, magnetostrictive characteristics, noise characteristics and shape characteristics were examined in the same way as that in Experiment 1-(1), the results being shown in FIG. 4.

As will be seen from FIG. 4, it is possible to improve all the characteristics, i.e., the magnetic characteristics, magnetostrictive characteristic, noise characteristics and shape characteristics, when the energy density was set to about 9.0 J/cm$^2$ or less. However, the iron loss was increased when the energy density was reduced to a level below about 2.0 J/cm$^2$.

It was thus confirmed that, when the electron beam irradiation is conducted in a spot manner along a zigzag path, all the characteristics including the magnetic characteristics, magnetostrictive characteristics, noise characteristics and shape characteristics, as well as iron loss characteristics, are improved when the electron beam characteristic was selected to range from about 2.0 to 9.0 J/cm$^2$.

As stated before, in the technique disclosed in the U.S. Pat. No. 4,919,733, the energy density is 60 J/in$^2$ (9.3 J/cm$^2$) or greater. Thus, as will be understood from the foregoing description of Experiments, the present invention makes it possible to effectively refine the magnetic domains with an energy density level much lower than that employed in the above-mentioned United States Patent.

The technique disclosed in the above-mentioned United States Patent cannot provide any improvement of magnetostrictive characteristics, noise characteristics or steel shape characteristics, although it can improve the magnetic characteristics appreciably.

It is to be understood that the present invention improves not only the magnetic characteristics but also other important characteristics such as magnetostrictive characteristics, noise characteristics and steel shape characteristics of the sheet.

Experiment 2-(1)

A silicon steel slab was prepared having a composition containing C: 0.079 wt. %, Si: 3.36 wt. %, Mn: 0.08 wt. %, Mo: 0.012 wt. %, sol.Al: 0.025 wt. %, Se: 0.019 wt. % and Sb: 0.025 wt. %. The slab was heated for 3 hours at 1360° C., followed by hot rolling, whereby a hot-rolled sheet of 2.2 mm thick was obtained.

The hot-rolled slab was then subjected to cold rolling and subsequent annealing conducted for 2 minutes at 1050° C., followed by a second cold rolling, whereby a final cold-rolled sheet 0.23 mm thick was obtained.

This final cold-rolled sheet was then subjected to decarburization and primary recrystallization annealing conducted in a wet hydrogen atmosphere at 840° C.

Then, an annealing separation agent in the form of a slurry composed mainly of MgO was applied to the surface of the steel sheet, and the temperature of the steel sheet was raised at a rate of 10° C./h and annealing was conducted for 15 hours at 850° C. Then, the steel temperature was raised to 1180° C. at a rate of 12° C./hr to allow preferential growth of the secondary recrystallized grains, followed by purification annealing which was conducted for 5 hours in a dry hydrogen atmosphere of 1220° C.

Then, an insulating film mainly composed of a phosphate and colloidal silica was formed on each of the steel sheets, whereby grain oriented silicon steel sheets were obtained.

Then, electron beam irradiation was conducted by employing the electron beam apparatus of FIG. 1, in either one of two irradiation modes, as in Example 1-(1), as follows:

In the first irradiation mode, as shown in FIG. 2, the electron beam was applied along straight paths extending in the direction perpendicular to the direction of rolling of the steel sheet at a scanning pitch $P_1$ of 6 mm.

Beam acceleration voltage: 150 KV
Beam current: 0.9 mA
Beam diameter: 0.19 mm
Energy density: 7.1 J/cm$^2$
Scanning velocity: 1000 cm/sec In the second irradiation mode, as shown in FIG. 3, the electron beam was applied intermittently so as to irradiate apices 2 and bottoms 3 of the zigzag wave 1. In FIG. 3, the centers of the consecutive circles show the points irradiated with the electron beam.

The zigzag path of the beam was so determined to have an amplitude H of 0.23 mm, period length of 0.4 mm and a scanning pitch $P_2$ of 6 mm. The angle $\theta$ of inclination of the zigzag wave with respect to the direction perpendicular to the steel sheet rolling direction was 11.3°.

The condition of application of the electron beam was as follows:

Beam acceleration voltage: 150 KV
Beam current: 0.9 mA
Beam diameter: 0.19 mm
Energy density: 7.1 J/cm$^2$
Scanning velocity: 1000 cm/sec For comparison, samples were prepared also for steel sheets which had not undergone electron beam irradiation.

Characteristics or properties such as magnetic characteristics, magnetostrictive characteristics, noise characteristics and shape characteristics were examined on all these samples, the results being shown in Table 2. The evaluation methods were the same as those employed in Experiment 1-(1).

TABLE 2

| | Magnetic Characteristics | | | | |
|---|---|---|---|---|---|
| Irradiation Mode | Iron Loss $W_{17/50}$(W/kg) | Magnetic Flux Density $B_8$/(T) | Excitation Power (VA/kg) | Noise (db) | C-Deflection (mm) |
| Linear | 1.92 | 0.79 | 3.6 | 58 | 2.5 |
| Zigzag | 1.93 | 0.76 | 2.7 | 54 | 1.5 |
| Not Irradiated | 1.93 | 0.90 | 2.5 | 53 | 1.2 |

From Table 2, it is shown that samples which had undergone magnetic domain refining treatment by electron beam irradiation exhibited remarkably reduced iron loss as compared with samples which were not subjected to such treatment. It is to be understood, however, that the magnetostrictive characteristics, noise characteristics and shape characteristics of the sheet were seriously impaired when the electron beams was applied along a linear path. Nevertheless, the magnetostrictive characteristics, noise characteristics and shape characteristics were remarkably improved when the electron beam irradiation was conducted in zigzag form, as compared with the case where the electron beam was applied along a straight path.

Experiment 2-(2)

The inventors also conducted an experiment to examine how the magnetic characteristics, magnetostrictive characteristics, noise characteristics and shape characteristics are influenced by the angle $\theta$ of inclination of the zigzag wave of FIG. 3 with respect to a direction perpendicular to the rolling direction, when irradiation is conducted in a spot manner along zigzag path.

The experiment was conducted on the grain oriented silicon steel sheet produced in Experiment 2-(1) by applying the electron beam in an intermittent or spot manner on the apices 2 and the bottoms 3 of the zigzag wave 1 as shown in FIG. 3, by using the apparatus shown in FIG. 1.

In this experiment, the period length L was fixed at 0.4 mm whereas the amplitude H of the zigzag wave was varied within the range between 0 and 0.2 mm. The inclination angle $\theta$ also was varied within the range between 0° and 45°. The angle $\theta$ being 0 means that the irradiation was conducted along a linear path. The scanning pitch $P_2$ was fixed to 6 mm.

Other conditions were as follows:

Beam acceleration voltage: 150 kV

Beam current: 0.5 to 1.5 mA

Beam diameter: 0.2 to 0.3 mm

Figure 5:
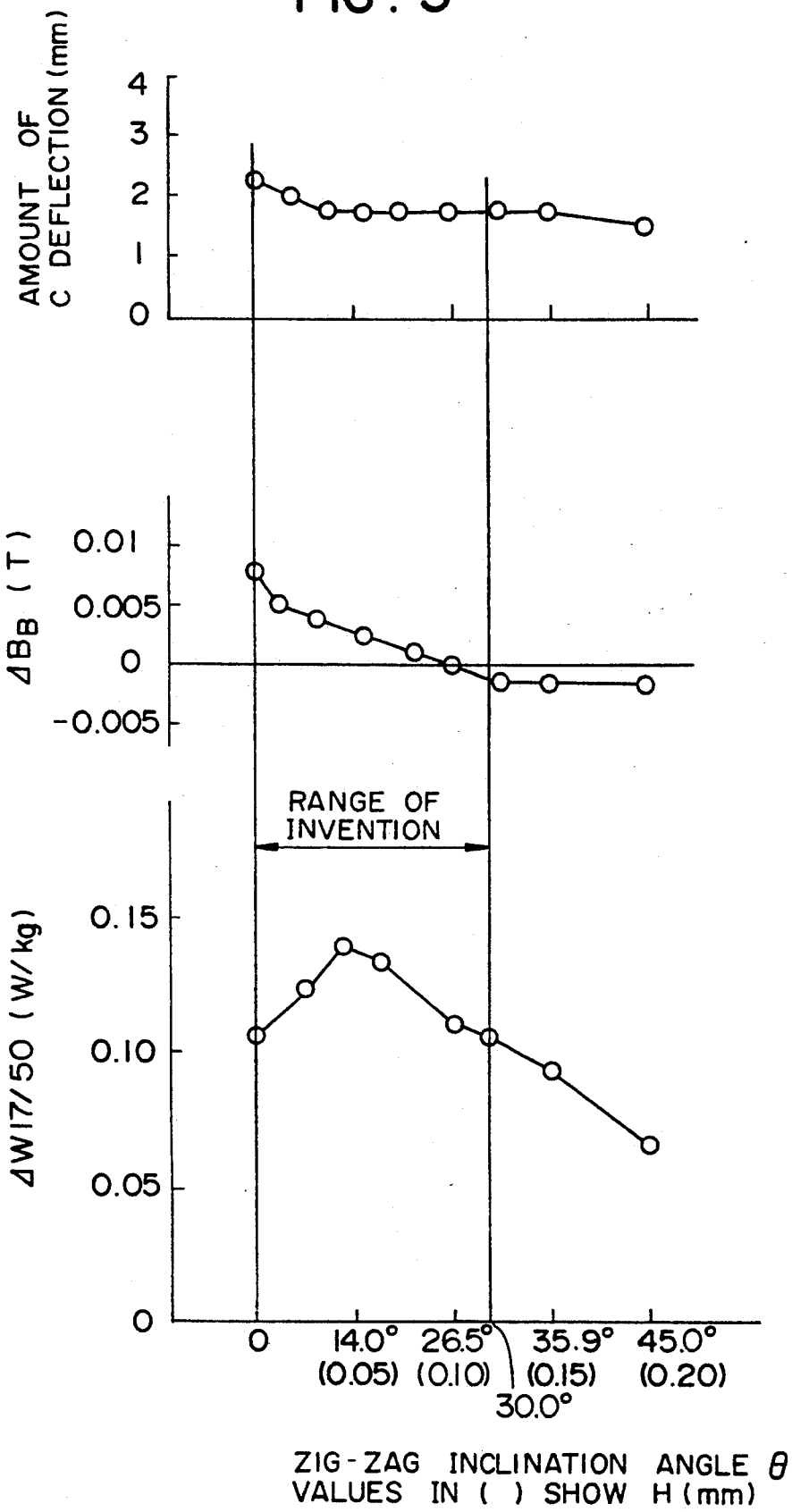
FIG. 5 is a graph showing how the reductions in the amount of C-deflection, magnetic flux density and iron loss are influenced by the angle $\theta$ of inclination of a zigzag path.

The iron loss, magnetic flux density and the amount of C-deflection were examined on the thus-obtained steel sheets to obtain results as shown in FIG. 5.

The iron loss is expressed in terms of $\Delta W_{17/50}$ which is the difference between the value $W_{17/50}$ measured before the electron beam irradiation and that measured after the irradiation.

The magnetic flux density is expressed in terms of $\Delta B_8$ which is the difference between the value $B_8$ measured before the electron beam irradiation and that measured after the irradiation.

The following facts are confirmed from the results shown in FIG. 5.

The iron loss characteristic is improved as compared with the case of irradiation along linear path when the angle $\theta$ of inclination is not greater than 30° but more than 0°. The iron loss, however, increases as compared with the case of irradiation along linear path, when the above-mentioned angle exceeds 30°.

The magnetic flux density increases in accordance with the increase in the inclination angle q. The amount of C-deflection, however, decreases in accordance with increase in the inclination angle q, whereby a grain oriented silicon steel sheet having excellent shape characteristics is obtained.

The present inventors also have confirmed, through experiments, that various advantageous characteristics obtained with the intermittent electron beam along a zigzag path can be enjoyed also when the irradiation with the electron beam is conducted continuously along such a zigzag path, as will be understood from the description of Examples which will be given later.

Any grain oriented silicon steel sheet composition known heretofore may be employed in the present invention. Typically, however, the following composition is preferably employed.

C: about 0.01 to 0.10 wt. %

This element is effective in uniformly refining the structure both in hot rolling and cold rolling, and also serves in development in Goss orientation. To obtain appreciable effects, the C content is preferably about 0.01 wt. % or greater. However, the Goss orientation is disturbed when the C content exceeds about 0.10 wt. %. The C content, therefore, should not exceed about 0.10 wt. %.

Si: about 2.0 to 4.5 wt. %

This element effectively contributes to reduction in the iron loss by enhancing the specific resistance of the steel sheet. Si content below about 2.0 wt. %, however, causes not only a reduction of specific resistance but also a random crystal orientation as a result of an $\alpha$-$\gamma$ transformation which takes place in the course of the final hot annealing which is conducted for the purpose of secondary recrystallization/annealing, thus hampering the reduction of the iron loss. Conversely, cold rolling characteristics are impaired when the Si content exceeds about 4.5 wt. %. The lower and upper limits of the Si content, therefore, are preferably about 2.0 wt. % to 4.5 wt. %.

Mn: about 0.02 to 0.12 wt. %

In order to avoid hot embrittlement, the Mn content should be at least about 0.02 wt. %. A too large Mn content, however, degrades the magnetic characteristics of the sheet. The upper limit of the Mn content, therefore, is about 0.12 wt. %.

Inhibitors suitably employed can be sorted into three types: the MnS type, the MnSe type and the AlN type. When an inhibitor of the MnS type or MnSe type is used, one or both selected from the group consisting of S: about 0.005 to 0.06 wt. % and Se: about 0.005 to 0.06 wt. % is preferably used.

S and Se are elements which can effectively be used as inhibitor to control secondary recrystallization in grain oriented silicon steel sheet. For obtaining sufficient inhibiting effect, the inhibitor should be present in an amount which is at least about 0.005 wt. %. The effect of the inhibitor, however, is impaired when the content exceeds about 0.06 wt. %. Therefore, the lower and upper limits of the content of S or Se is set to about 0.005 wt. % and about 0.06 wt. %, respectively.

When an inhibitor of the AlN type is used, both Al: about 0.005 to 0.10 wt. % and N: about 0.004 to 0.15 wt. % are to be present. The contents of Al and N should be determined to fall within the above-mentioned ranges of contents of inhibitor of the MnS or MnSe type for the same reasons as stated above.

It is also possible to use other elements than S, Se and Al as the inhibitor, such as Cr, Mo, Cu, Sn, Ge, Sb, Te, Bi and P. Trace amounts of these elements may be used in combination as the inhibitor. More specifically, contents of Cr, Cu and Sn are preferably not less than about 0.01 wt. % but not more than about 0.50 wt. %, whereas, for Mo, Ge, Sb, Te and Bi, the contents are preferably not less than about 0.005 wt. % but not more than about 0.1 wt. %. The content of P is preferably not less than about 0.01 wt. % but not more than about 0.2 wt. %. Each of these inhibitors may be used alone or a plurality of such inhibitors may be used in combination.

EXAMPLES

Example 1

A silicon steel slab was prepared with a composition containing C: 0.042 wt. %, Si: 3.48 wt. %, Mn: 0.073 wt. %, Mo: 0.012 wt. %, Se: 0.020 wt. % and Sb: 0.022 wt. %. The slab was heated for 4 hours at 1380° C., followed by hot rolling, whereby a hot-rolled sheet of 2.2 mm thick was obtained.

The hot-rolled slab was then subjected to cold rolling and subsequent annealing conducted for 2 minutes at 1050° C., followed by a second cold rolling, whereby a final cold-rolled sheet of 0.23 mm thick was obtained.

This final cold-rolled sheet was then subjected to decarburization and primary recrystallization annealing conducted in a wet hydrogen atmosphere of 840° C.

Then, an annealing separation agent in the form of a slurry composed mainly of MgO was applied to the surface of the steel sheet, and the temperature of the steel sheet was raised at a rate of 10° C./h and annealing was conducted for 20 hours at 850° C. Then, the temperature was raised to 1180° C. at a rate of 8° C./hr, allowing preferential growth of secondary recrystallization grain of Goss orientation. Then, purification annealing was conducted for 8 hours in a dry hydrogen atmosphere of 1220° C.

Then, an insulating film mainly composed of a phosphate and colloidal silica was formed on each of the steel sheets, whereby two types of grain oriented silicon steel sheets were obtained.

Figure 6:
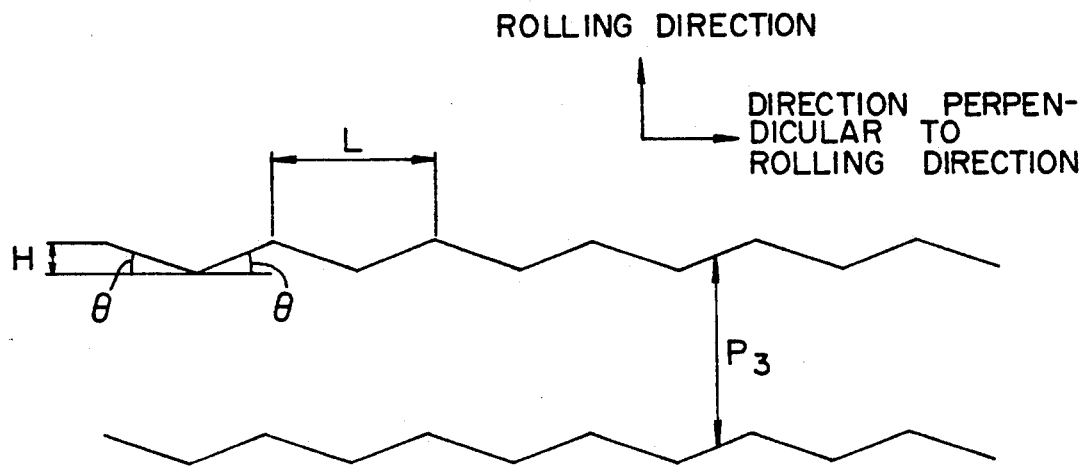
FIG. 6 is a plan view schematically showing the manner in which the electron beam is applied in accordance with the present invention.

Then, electron beam irradiation was conducted by employing the electron beam apparatus of FIG. 1, along a zigzag path as shown in FIG. 6.

The amplitude H of the zigzag wave and its period length L were set at H=0.33 mm and L=0.6 mm, respectively. The angle of inclination of the zigzag wave to the direction perpendicular to the direction of rolling of the steel sheet was $\theta=15.6°$ and the pitch $P_3$ of scanning was set at $P_3=6$ mm.

Other conditions of electron beam irradiation were as follows:

Beam acceleration voltage: 150 KV
Beam current: 1.6 mA
Beam diameter: 0.25 mm
Energy density: 6.3 J/cm$^2$
Scanning velocity: 1500 cm/sec The magnetic characteristics, magnetostrictive characteristics, noise characteristics and steel sheet shape characteristics of the thus-obtained products, referred to as "Sample A" were examined and evaluated. The evaluation methods were the same as those in Experiment 1-(1). The results are shown in Table 3.

For comparison, electron beam irradiation was conducted on the same silicon steel sheet under the same irradiating conditions as those in this Example, along straight or linear paths perpendicular to the direction of rolling of the steel sheet, at a scanning pitch P1 of 6 mm, as shown in FIG. 2. The results of measurement and evaluation of the characteristics of this Comparison Example are also shown in Table 3.

TABLE 3

| Sample | Magnetic Characteristics: Magnetic Flux Density $B_8$/(T) | Iron Loss $W_{17/50}$(W/kg) | Excitation Power (VA/kg) | Noise (db) | C-Deflection (mm) |
|---|---|---|---|---|---|
| A | 1.91 | 0.79 | 2.6 | 55 | 1.6 |
| Comparison Example | 1.91 | 0.88 | 3.8 | 59 | 2.4 |

Example 2

A silicon steel slab was prepared having a composition containing C: 0.020 wt. %, Si: 3.52 wt. %, Cu: 0.2 wt. %, Sn: 0.08 wt. % and Al: 0.024 wt. %. The slab was heated for 4 hours at 1380° C., followed by hot rolling, whereby a hot-rolled sheet of 2.2 mm thick was obtained.

The hot-rolled slab was then subjected to cold rolling and subsequent annealing conducted for 2 minutes at 1050° C., followed by a second cold rolling, whereby a final cold-rolled sheet of 0.23 mm thick was obtained.

This final cold-rolled sheet was then subjected to decarburization and primary recrystallization annealing conducted in a wet hydrogen atmosphere of 840° C.

Then, an annealing separation agent in the form of a slurry composed mainly of MgO was applied to the surface of the steel sheet, and the temperature of the steel sheet was raised at a rate of 10° C./h and annealing was conducted for 20 hours at 850° C. Then, the temperature was raised to 1180° C. at a rate of 8° C./hr, allowing preferential growth of secondary recrystallization grain of Goss orientation. Then, purification annealing was conducted for 8 hours in a dry hydrogen atmosphere of 1220° C.

Then, an insulating film mainly composed of a phosphate and colloidal silica was formed on each of the steel sheets, whereby two types of grain oriented silicon steel sheets were obtained.

Then, electron beam irradiation was conducted by employing the electron beam apparatus of FIG. 1, along a zigzag path as shown in FIG. 6.

The amplitude H of the zigzag wave and the period length L of the same were set at H=0.33 mm and L=0.6 mm, respectively. The angle of inclination of the zigzag wave to the direction perpendicular to the direction of rolling of the steel sheet was $\theta=15.6°$ and the pitch $P_3$ of scanning was set at $P_3=6$ mm.

Other conditions of electron beam irradiation were as follows:

Beam acceleration voltage: 150 KV
Beam current: 1.6 mA
Beam diameter: 0.25 mm
Energy density: 6.3 J/cm$^2$ The magnetic characteristics, magnetostrictive characteristics, noise characteristics and steel sheet shape characteristics of the thus-obtained product, referred to as "Sample B" were examined and evaluated. The evaluation methods were the same as those in Experiment 1-(1). The results are shown in Table 3.

For comparison, electron beam irradiation was conducted on the same silicon steel sheet under the same irradiating conditions as those in this Example, along straight or linear paths perpendicular to the direction of rolling of the steel sheet, at a scanning pitch $P_1$ of 6 mm, as shown in FIG. 2. The results of measurement and evaluation of the characteristics of this Comparison Example are also shown in Table 4.

TABLE 4

| Sample | Magnetic Characteristics: Magnetic Flux Density $B_8$/(T) | Iron Loss $W_{17/50}$(W/kg) | Excitation Power (VA/kg) | Noise (db) | C-Deflection (mm) |
|---|---|---|---|---|---|
| B | 1.93 | 0.76 | 2.5 | 54 | 1.3 |
| Comparison Example | 1.93 | 0.90 | 3.2 | 59 | 2.6 |

From Tables 3 and 4, it will be understood that Samples A and B, produced by the method of the present invention, were superior to the Comparison Examples in magnetic characteristics, exciting power characteristics, noise characteristics and C-deflection characteristics.

As has been described, the present invention provides a method which makes it possible to produce a grain oriented silicon steel sheet having superior magnetic characteristics, and in particular obtaining a significantly reduced iron loss, without deterioration of magnetostrictive characteristics, noise characteristics and steel sheet shape characteristics. In addition, according to the invention, this advantageous effect is achieved with a smaller level of energy density as compared with known art.

Although this invention has been described in its specific form, it is to be understood that the described examples are only illustrative and that various changes and modifications are possible within the scope of the invention which is limited solely by the appended claims.

What is claimed is:

1. A method of producing a low iron loss grain oriented silicon steel sheet having improved magnetostrictive characteristics when used as a stacked iron core and low noise when used in a stacked transformer, as well as superior shape characteristics, comprising the steps of:

preparing a grain oriented finish-annealed silicon steel sheet;

forming an insulating film on a surface of said grain oriented silicon steel sheet;

irradiating said surface of said grain oriented silicon steel sheet with an electron beam along a multiplicity of spaced paths so as to refine the magnetic domains;

wherein said irradiation with said electron beam is conducted continuously or intermittently along a wave-form path on the surface of said grain oriented silicon steel, said wave-form having a period length much smaller than the width of said grain oriented silicon steel sheet and said wave-form path extends substantially perpendicularly to the direction of rolling of said grain oriented silicon steel sheet.

2. A method of producing a low iron loss grain oriented silicon steel sheet according to claim 1, wherein said wave-form is a zigzag path having apices and valleys.

3. A method of producing a low iron loss grain oriented silicon steel sheet according to claim 2, wherein the irradiation with said electron beam is conducted intermittently in such a manner that said beam is spotted only on said apices and valleys.

4. A method of producing a low iron loss grain oriented silicon steel sheet according to claim 1 wherein said electron beam has an energy density level of about 2 to 9 J/cm$^2$.

5. A method of producing a low iron loss grain oriented silicon steel sheet according to claim 2 wherein said electron beam has an energy density level of about 2 to 9 J/cm$^2$.

6. A method of producing a low iron loss grain oriented silicon steel sheet according to claim 3, wherein said electron beam has an energy density level of about 2 to 9 J/cm$^2$.

7. A method of producing a low iron loss grain oriented silicon steel sheet according to anyone of claims 1 to 4, 5 and 6 wherein said zigzag path has an angle $\theta$ of inclination to the direction perpendicular to said direction of rolling, and wherein said angle $\theta$ is not greater than 30°, and wherein said zigzag form has an amplitude of about 0.2 to 1.0 mm and wherein said zigzag form has a period length of about 0.4 to 2.0 mm.

* * * * *

UNITED STATES PATENT AND TRADEMARK OFFICE

CERTIFICATE OF CORRECTION

PATENT NO. : 5,296,051

DATED : March 22, 1994

INVENTOR(S) : Yukio Inokuti et al

It is certified that error appears in the above-indentified patent and that said Letters Patent is hereby corrected as shown below:

In column 12, after line 38 (6.3 J/cm$^2$), insert a line
--Scanning Velocity: 1500 cm/sec--

Signed and Sealed this

Fifth Day of July, 1994

*Attest:*

Bruce Lehman

BRUCE LEHMAN

*Attesting Officer*

*Commissioner of Patents and Trademarks*